US005528249A

United States Patent [19]

Gafford et al.

[11] Patent Number: 5,528,249

[45] Date of Patent: Jun. 18, 1996

[54] ANTI-ICE RADOME

[76] Inventors: George Gafford, 1420 Knollwood Cir., Orlando, Fla. 32804; Paul H. Gebert, 10012 Creekwater Blvd., Orlando, Fla. 32825; Walter S. Arceneaux, 3129 Cayman Way, Orlando, Fla. 32812; Rickey D. Akins, 3209 S. Semoran Blvd., Apt. 70, Orlando, Fla. 32822

[21] Appl. No.: 988,321

[22] Filed: Dec. 9, 1992

[51] Int. Cl.[6] ..... H01Q 1/02

[52] U.S. Cl. ..... 343/704; 343/700 MS; 343/770; 343/771; 343/872; 343/873; 343/909

[58] Field of Search ..... 343/704, 700 MS, 343/770, 771, 872, 873, 909; H01Q 1/02

[56] References Cited

U.S. PATENT DOCUMENTS

| | | | |
|---|---|---|---|
| 3,146,449 | 8/1964 | Serge et al. | 343/704 |
| 3,633,206 | 1/1972 | McMillan | 343/909 X |
| 3,789,404 | 1/1974 | Munk | 343/18 B |
| 3,829,862 | 8/1974 | Young | 343/767 |
| 3,871,001 | 3/1975 | Myers | 343/872 |
| 3,975,738 | 8/1976 | Pelton et al. | 343/872 |
| 4,700,193 | 10/1987 | Sa et al. | 343/770 X |
| 4,999,639 | 3/1991 | Frazita et al. | 343/704 |
| 5,011,098 | 4/1991 | McLaren et al. | 244/134 B |
| 5,208,603 | 5/1993 | Yee | 343/872 X |

FOREIGN PATENT DOCUMENTS

| | | | |
|---|---|---|---|
| 2551366 | 5/1977 | Germany | 343/704 |
| 57-65006 | 4/1982 | Japan | 343/704 |

*Primary Examiner*—Donald Hajec
*Assistant Examiner*—Steven Wigmore

[57] ABSTRACT

An anti-ice radome having a frequency selective surface and a plurality of resistive heating elements is disclosed. The frequency selective surface prevents the resistive heating elements from disturbing the electromagnetic waves generated by an antenna within the radome. Thus, ice formation on the radome can be prevented without sacrificing the transmission characteristics of the radome.

15 Claims, 3 Drawing Sheets

ANTI-ICE RADOME

BACKGROUND

The present invention relates generally to sensor domes, for example, antenna radomes. More specifically, the present invention relates to methods and systems for preventing ice from forming on antenna radomes.

Antenna radomes are provided in hostile environments as physical protection for antennas which transmit electromagnetic waves. Naturally, a primary concern in designing these radomes is that they do not adversely effect the transmitted or received electromagnetic waves and thereby reduce the effectiveness of the transmitting or receiving device (e.g., a radar). Radomes can adversely impact these transmissions in at least two ways. First, radomes can reduce the overall energy output of the transmitted waves by attenuating the waves as they pass through the radome. Second, radomes can distort or shift the phase of the waves so that the desired electromagnetic transmissions do not occur and, in the case of radar, returning electromagnetic waves are inaccurate.

Unfortunately, these problems lead to many design compromises. For example, continuous metal layers cannot be used to form the radomes since such materials would attenuate the electromagnetic waves to an unacceptable degree. Thus, various types of dielectric material are typically used to fabricate radome walls despite their generally inferior strength characteristics compared to metals.

Further complicating this situation is the problem of anti-icing. In many applications, radomes and antennas are disposed in environments where ice can form on the radome. For example, radomes located on airplanes or helicopters are highly susceptible to icing. Ice build-up on the outside surface of a radome compounds both of the above-described problems of attenuation and distortion of the transmitted electromagnetic waves. Not surprisingly, radome designers have been experimenting with methods and devices for preventing ice formation on radomes for some time.

One proposed anti-icing solution is to heat the air either in the interior of the radome or in ducts which are located within the radome walls. Heating the interior of the radome has been found to be ineffective in some situations because the radome's dielectric walls act as insulators and ice still forms depending on variables such as the environmental conditions, thickness of the radome walls, and amount of heat generated.

The solution of providing air ducts into the radome walls suffers from many drawbacks when actually implemented. For example, the resulting radome walls are bulky, complex to manufacture and lack structural integrity. Further, the asymmetrical nature of such radome walls tends to cause distortion of the outgoing electromagnetic waves.

Another solution is to incorporate resistive heating elements into the radome walls and pass current through the heating elements to heat the radome walls in a manner analogous to rear-window defrosters in automobiles. This solution is problematic, however, in that the heating elements also distort and/or attenuate the electromagnetic waves.

U.S. Pat. No. 4,999,639 to Frazita et al., discloses a radome having heating elements that are embedded or printed in the dielectric layers composing the radome walls. The heating elements are configured to provide impedance matching for the dielectric radome walls relative to the ambient environment. In this way, attenuation of the electromagnetic waves is allegedly reduced below the attenuation level that occurs from transmitting through the dielectric material alone. Moreover, the heating elements are spaced a distance of at most one-half of the operating wavelength of the antenna to minimize distortion.

However, the radome disclosed in the Frazita patent suffers from the drawback that it only prevents distortion or attenuation for transmitted electromagnetic fields having polarizations that are not parallel to the conductors embedded in the radome. Thus, this solution does not overcome anti-icing problems for radomes having antennas which transmit electromagnetic waves of varying polarizations.

SUMMARY

These and other drawbacks are solved by radomes according to exemplary embodiments of the present invention, wherein a frequency selective surface is provided as one of the layers of the radome wall. The frequency selective surface allows transmission of electromagnetic waves of at least one operating frequency of the antenna with minimal attenuation or distortion regardless of the polarization of the electromagnetic field.

In one exemplary embodiment, the frequency selective surface is formed on one conductive side of an insulating sheet while conductors are printed or formed on the other conductive side of the insulating sheet. These conductors are connected to a power source and act as heating elements for the radome. In another exemplary embodiment, the frequency selective surface itself acts as a heating element by passing current therethrough.

According to the present invention, the combination of a frequency selective surface and anti-icing resistive heating in a radome provides anti-icing without distortion or attenuation of the electromagnetic waves transmitted through the radome. Moreover, the resistance heating provided by the present invention is more efficient than the above-described conventional air-heated radomes in combating the formation of ice on the radome.

BRIEF DESCRIPTION OF THE DRAWINGS

These and other features, objects, and advantages of the present invention will become more apparent when the following detailed description is read in conjunction with the drawings in which.

DETAILED DESCRIPTION

Figure 1:
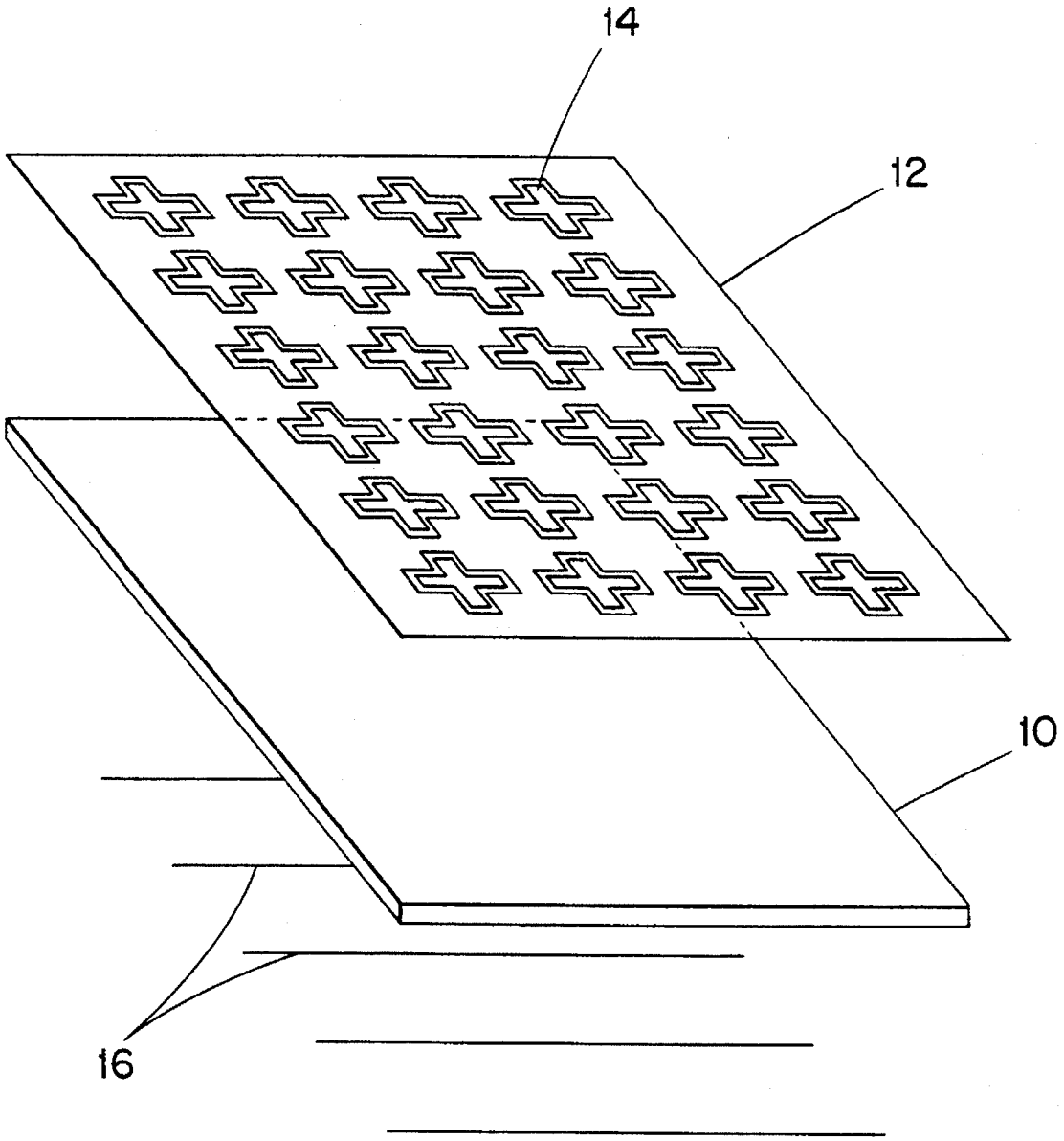
FIG. 1 shows an exemplary embodiment of the present invention wherein a frequency selective surface in combination with heating elements comprises an anti-icing grid.
Figure 2:
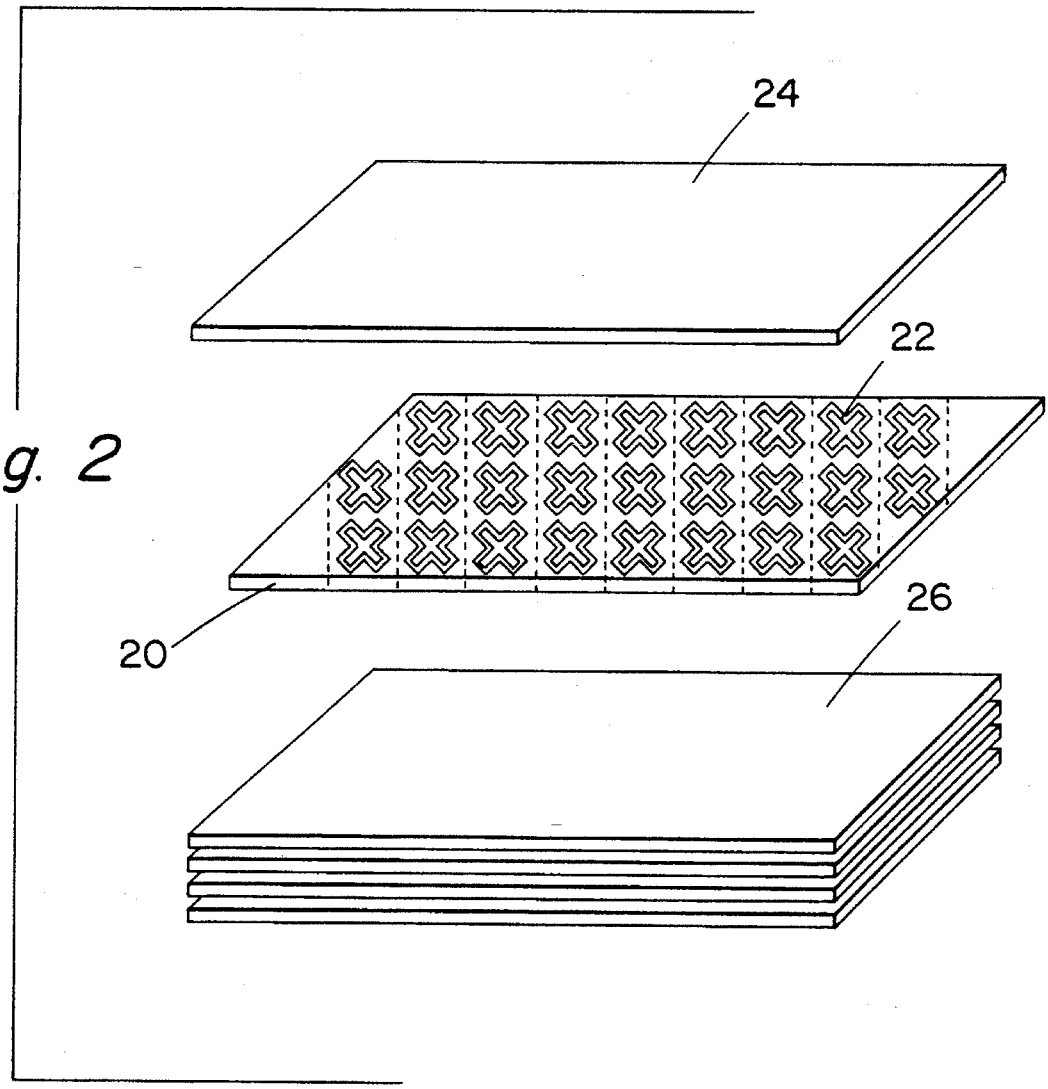
FIG. 2 illustrates the anti-icing grid of FIG. 1 as it can be used to form a composite surface.

Radomes according to exemplary embodiments of the present invention include an anti-icing grid which heats the radome walls to prevent the formation of ice as shown in FIGS. 1 and 2. An anti-icing grid shown in FIG. 1 comprises a combination of a frequency selective surface 12 and a plurality of heating elements 16, such as metal wires or strips, (shown as hidden lines in FIG. 2) formed on opposite sides of an insulating sheet 10.

The phrase "frequency selective surface" as it is used throughout this description refers to a surface which is designed to pass electromagnetic waves having at least one predetermined operating frequency and block, to the extent any metal or insulating sheet blocks, any other frequencies. One exemplary type of frequency selective surface comprises a metal sheet in which slotted elements of a specific shape and size are formed at periodic intervals. These slotted elements act in a manner analogous to a bandpass filter to allow transmission of electromagnetic waves at the resonant frequency of the enclosed antenna without transmission loss at any incident angle and polarization. Examples of such frequency selective surfaces are disclosed in U.S. Pat. No. 3,789,404 to Munk and U.S. Pat. No. 3,975,738 to Pelton et al., which are hereby incorporated by reference.

FIGS. 1 and 2 illustrates the formation of an anti-icing grid according to an exemplary embodiment of the present invention. An insulating sheet 10 has a plurality of slotted elements 22 formed on one conductive side 12 thereof so that the insulating sheet acts as a frequency selective surface. The insulating sheet 10 can, for example, be made from "DUROID" and thus comprises outer layers of a conductive material, such as copper, separated by an insulator, such as a filled TEFLON or PTFE polymer. As is known, these slotted elements can be formed using conventional printed circuit board fabrication techniques to achieve the necessary precision. Thus, for example, the slotted elements 22 can be formed in a conductive side of the insulating sheet 10 by placing a photoresist mask 12 having a predetermined pattern of slotted openings 14 on a surface of the sheet and etching these slots in the insulating sheet 10 using known photolithographic techniques. The manner in which the layout and design of the slots are selected so that the insulating sheet 10 transmits only a predetermined operating frequency are not further described herein as these considerations are beyond the scope of the present disclosure.

Moreover, although the exemplary predetermined pattern of slotted openings 14 of FIG. 1 is shown as a plurality of cross-shaped openings, those skilled in the art will appreciate that the present invention can be implemented using any type of frequency selective surface. Thus the particular configuration, size, and spacing of the slotted openings can be varied to accommodate different antenna operating frequencies and other design considerations. For example, the tri-slot type openings shown in U.S. Pat. No. 3,975,738 could be used to form the frequency selective surface instead of the cross-shaped opening of FIGS. 1 and 2.

Resistive heating elements 16 are formed or embedded on the conductive layer on the opposite side of the insulating sheet 10 from the frequency selective surface in rows between the slotted openings 22. One way in which these heating elements can be provided is by using photolithography to form heating elements from the conductive layer of insulating sheet itself. Alternately, copper or other conductive metal wires such as aluminum or nichrome can be embedded in the insulating sheet 10. For the frequency selective surface to eliminate the distorting and attenuating effects of the resistive heating elements 16, these elements are spaced relatively closely from the slotted openings 22. For example, the resistive heating elements can preferably be formed at a depth of within about 5–10 mils of the slotted openings according to this exemplary embodiment.

Another feature of this exemplary embodiment of the present invention is that the cross-sectional area of the resistive heating elements 16 can be varied to be both small enough not to interfere with the frequency selective surface and, at the same time, to use a readily available voltage directly without requiring a level-shifting transformer. This aspect of the invention is discussed below with reference to the following equations:

$$A_c = \frac{r \cdot Q}{N \cdot \left(\frac{E}{LM}\right)^2} \text{ in}^2 \tag{1}$$

$$\frac{N}{M} = \frac{N_b}{W} \tag{2}$$

where:

E=available voltage (volts);

L=radome length dimension (inches);

M=number of wires per branch (integer);

N=number of wires per inch (spacing, $\text{in}^{-1}$);

$N_b$=number of branches (integer);

Q=power output required to anti-ice (watts/$\text{in}^2$);

r=resistivity (Ω-in); and

W=radome width dimension (in).

Equation (1) solves for the cross-sectional area of the resistive heating elements in a radome according to an exemplary embodiment of the present invention. Most of the variables in equation (1) are usually fixed for a particular application, e.g., a radome in a particular aircraft. For example, the resistivity r of the selected conductor material is a known characteristic of the conductor material. The power required for anti-icing Q is a design value which is selected based on, for example, the icing environment in which the radome is expected to operate, the radome geometry, an allowance for heat losses to the structure and a safety margin.

The number of wires per inch N is defined by the type of frequency selective surface pattern which is chosen based on the operating frequency or frequencies of the antenna. The available voltage E is determined by the power supply of the vehicle or installation to which the radome will be connected. Thus, typically, the variables r, Q, N, E, L, and W are fixed prior to design of the conductor size.

As can be seen from equation (2), however, the cross-sectional area of the conductors $A_c$ can be reduced by increasing the number of branches $N_b$ in the conductor pattern. Consequently, a radome according to the present invention can be tailored to any existing voltage supply in a vehicle or installation by varying the number of branches in the heating circuit so that the cross-sectional area of the resistive heating elements is small enough to not interfere with the frequency selective function.

The following tables illustrate an example of this feature of the present invention. Table 1 shows exemplary values of the above-described equations for a hypothetical application.

TABLE 1

| |
|---|
| Spacing of 0.109 in. : N = 9.174 $\text{in}^{-1}$ |
| Copper: r = 0.6772 × $10^{-6}$ Ω-in. |
| Nichrome IV: r = 39.4 × $10^{-6}$ Ω-in. |
| Required Heat: Q = 4.5 watts/$\text{in.}^2$ |
| Voltage: E = 105 V |
| Dimensions: L = 42 in. W = 18 in. |
| Total Wires: N × W = 165 = M × $N_b$ |

Table 2 illustrates some of the possible solutions given the parameters fixed in Table 1. Note that conductor size can be designed from a maximum size of $9.4\times10^{-3}$ $\text{in}^2$ to a minimum of $1.329\times10^{-6}$ $\text{in}^2$. This provides tremendous flexibility in designing anti-icing grids according to the present invention which can use existing power supplies while not interfering with the frequency selective surface.

TABLE 2

| $N_B$ | M | A, in$^2$ | √A, in | A, in$^2$ | √A, in |
|---|---|---|---|---|---|
| 3 | 55 | $9.4 \times 10^{-3}$ | 0.0967 | $1.608 \times 10^{-4}$ | 0.0127 |
| 15 | 11 | $3.74 \times 10^{-4}$ | 0.0193 | $6.431 \times 10^{-6}$ | 0.0025 |
| 33 | 5 | $7.73 \times 10^{-5}$ | 0.0088 | $1.329 \times 10^{-6}$ | 0.0012 |
| 165 | 1 | $3.092 \times 10^{-6}$ | 0.0018 | $5.315 \times 10^{-8}$ | 0.00023 |
| | | Nichrome IV | | Copper | |

FIG. 2 illustrates an exemplary embodiment wherein an anti-icing grid 20, fabricated as discussed above, is inserted between two of the dielectric layers 24 and 26 which comprise a radome wall. Alternately, the anti-icing grid can be fixed to the inner surface of the radome wall on dielectric layer 26 without the additional dielectric layer 24. Of course, those skilled in the art will readily appreciate that the insulative qualities of a dielectric layer which separates the anti-icing grid from the outer surface of the radome are taken into account when deciding upon an appropriate value for Q, as discussed above.

In such exemplary embodiments, the anti-icing grid can be formed on a very thin insulating sheet 10 so that it can be inserted between the dielectric layers of the radome walls with very little change in the overall thickness or manufacturing process of the radome. Thus, according to this exemplary embodiment, existing radomes can readily be retrofitted to include an anti-icing grid according to the present invention and conventional radome fabrication techniques can be modified to include the provision of an anti-icing grid at minimal cost.

Figure 3:
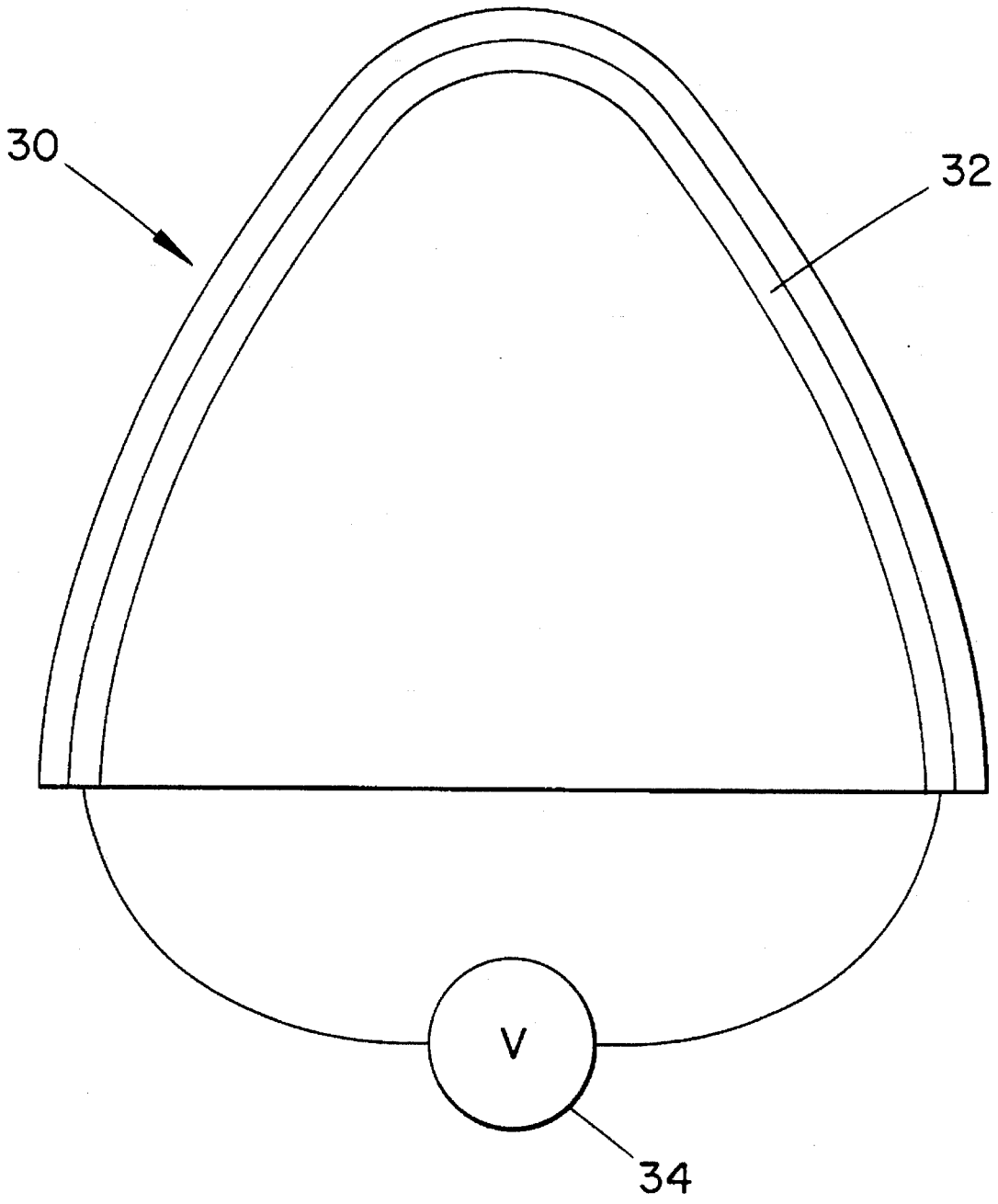
FIG. 3 illustrates a radome having walls including an anti-icing grid according to the present invention.

FIG. 3 illustrates a radome 30 according to the present invention including an anti-icing grid 20 shown therein as layer 32. A power source 34 is connected to opposite ends of the resistive heating elements 16 so as to generate a current therethrough. The power source 34 can be of any suitable type (e.g., an a.c. or d.c. source), and, as discussed above, will be a design consideration in sizing the conductors to generate enough heat to prevent ice formation for a particular radome in a particular environment.

In operation, an antenna (not shown) will generate electromagnetic waves having a desired operating frequency or frequencies. At that frequency or frequencies, the slotted openings 22 in the anti-icing grid 20 will resonate, which effectively re-radiates the electromagnetic waves generated by the antenna. Experimentation has shown that when the resistive heating elements 16 are formed or embedded on the insulating sheet 10 as discussed above, they do not distort or attenuate the transmitted electromagnetic waves as was the case in conventional radomes which incorporated anti-icing devices having resistive heating elements.

According to another exemplary embodiment of the present invention, heating of radome walls can be accomplished by passing a current through the frequency selective surface 12 itself without the provision of discrete resistive heating elements. While such an anti-icing grid can be manufactured more cheaply than the aforementioned exemplary embodiment having resistive wires, for certain applications design compromises may be necessary between the functions of heating and distortion free transmission. This is true because the optimal thickness of the conductive side of insulating sheet 10 on which the frequency selective circuit is formed has been found to differ for these two functions depending on the values of other parameters, such as available voltage.

While the present invention has been described in terms of the above-described exemplary embodiments, these embodiments are considered to be in all respects illustrative rather than limitative of the present invention. For example, although the present invention has been described as it applies to radomes, those skilled in the art will appreciate that the present invention is equally applicable to any structure requiring anti-icing capability which is used to house an electromagnetic wave generating device. Accordingly, the scope of present invention is intended to encompass any and all such modifications and equivalents thereof as set forth in the appended claims.

What is claimed is:

1. A radome comprising:

an insulating layer;

a frequency selective layer disposed on a first side of said insulating layer, having a plurality of openings formed therein in first rows which are spaced from one another by gaps;

a plurality of resistive elements formed integrally and defined as a conductive layer on a second, opposite side of said insulating layer, said resistive elements being formed in second rows such that said resistive elements define projections when said second rows are projected onto said frequency selective layer, at least some projections of said second rows lie in said gaps; and current passing means for passing current through said plurality of resistive elements.

2. The radome of claim 1, wherein said plurality of resistive elements are formed in said conductive layer at a depth of about 5–10 mils from said openings.

3. A radome comprising:

an insulating layer;

a frequency selective layer disposed on a first side of said insulating layer, having a plurality of openings formed therein in first rows which are spaced from one another by gaps;

a plurality of resistive elements formed on a second, opposite side of said insulating layer, said resistive elements being formed in second rows such that said resistive elements define projections when said second rows are projected onto said frequency selective layer, at least some projections of said second rows lie in said gaps, wherein said plurality of resistive elements are wires that are embedded in a conductive layer that comprises one of copper, nichrome, or aluminum; and current passing means for passing current through said plurality of resistive elements.

4. The radome of claim 3, wherein said plurality of resistive elements are embedded in said conductive layer at a depth of about 5–10 mils from said openings.

5. The radome according to claim 1, wherein said plurality of openings comprise a plurality of cross-shaped openings spaced at periodic intervals based on at least one operating frequency on said frequency selective layer.

6. The radome of claim 1, further comprising at least one dielectric layer adjacent said frequency selective layer.

7. The radome of claim 1, wherein said conductive layer comprises a copper substrate.

8. An anti-icing grid comprising:

an insulating layer;

a frequency selective layer disposed on a first side of said insulating layer having a plurality of openings formed therein in first rows which are spaced apart by gaps; and anti-icing means including a plurality of resistive elements formed on a second side of said insulating layer in second rows such that said resistive elements define projections when said second rows are projected onto said frequency selective layer, at least some projections of said second rows lie in said gaps.

9. The anti-icing grid of claim 8, wherein said anti-icing means further comprises:

current passing means for passing current through said plurality of resistive elements.

10. The anti-icing grid of claim 8, wherein said plurality of openings comprise a plurality of cross-shaped openings spaced at periodic intervals based on at least one operating frequency on said frequency selective layer.

11. The anti-icing grid of claim 8, further comprising at least one dielectric layer adjacent said frequency selective layer.

12. The anti-icing grid of claim 9, wherein said plurality of resistive elements are formed integrally in a conductive layer.

13. The anti-icing grid of claim 9, wherein said plurality of resistive elements are wires are embedded in a conductive layer that comprises one of copper, nichrome, or aluminum.

14. The anti-icing grid of claim 12, wherein said plurality of resistive elements are embedded in said conductive layer at a depth of about 5–10 mils from said openings.

15. The anti-icing grid of claim 13, wherein said plurality of resistive elements are embedded in said conductive layer a depth of about 5–10 mils from said openings.

* * * * *